US007107877B2

(12) United States Patent
Lee

(10) Patent No.: US 7,107,877 B2
(45) Date of Patent: Sep. 19, 2006

(54) RATCHET SCREWDRIVER

(76) Inventor: Yi-Min Lee, No. 52, Renmel Rd., Dali City, Taichung County (TW) 412

( * ) Notice: Subject to any disclaimer, the term of this patent is extended or adjusted under 35 U.S.C. 154(b) by 232 days.

(21) Appl. No.: 10/895,236

(22) Filed: Jul. 19, 2004

(65) Prior Publication Data

US 2006/0011018 A1 Jan. 19, 2006

(51) Int. Cl.
*B25B 13/46* (2006.01)

(52) U.S. Cl. ..... 81/63; 192/43.1

(58) Field of Classification Search ..... 81/63, 81/62, 63.1, 58, 58.1, 63.2; 192/43.1
See application file for complete search history.

(56) References Cited

U.S. PATENT DOCUMENTS

| | | | | |
|---|---|---|---|---|
| 2,292,228 | A * | 8/1942 | Krieger | 81/29 |
| 4,102,375 | A * | 7/1978 | Rossini | 81/30 |
| 6,070,501 | A * | 6/2000 | Braun et al. | 81/62 |
| 6,789,447 | B1 * | 9/2004 | Zinck | 81/57.13 |
| 2006/0011018 | A1 * | 1/2006 | Lee | 81/63 |

* cited by examiner

*Primary Examiner*—Lee D. Wilson
(74) *Attorney, Agent, or Firm*—Charles E. Baxley

(57) ABSTRACT

A ratchet screwdriver includes a main rod, a driven shaft, a ratchet mechanism, a socket connector, a control member, and a handle. Thus, the pawl member of the ratchet mechanism is pivoted to engage the ratchet teeth of the socket connector by rotation of the rotation wheel of the control member, so that the ratchet screwdriver is operated easily and conveniently, thereby facilitating a user operating the ratchet screwdriver to drive a workpiece.

12 Claims, 11 Drawing Sheets

RATCHET SCREWDRIVER

BACKGROUND OF THE INVENTION

1. Field of the Invention

The present invention relates to a ratchet screwdriver, and more particularly to a ratchet screwdriver that is operated easily and conveniently, thereby facilitating a user operating the ratchet screwdriver.

2. Description of the Related Art

A conventional screwdriver comprises a shank, and a driver head detachably mounted on a distal end of the shank. Thus, the driver head of the conventional screwdriver is used to rotate a workpiece, such as the screw, bolt, nut or the like. However, the conventional screwdriver does not have a ratchet mechanism, so that it cannot be operated easily and conveniently, thereby causing inconvenience to a user when operating the conventional screwdriver.

SUMMARY OF THE INVENTION

The primary objective of the present invention is to provide a ratchet screwdriver, wherein the ratchet mechanism is directly actuated by the control member to engage the socket connector, so that the ratchet screwdriver is operated actually and exactly.

Another objective of the present invention is to provide a ratchet screwdriver, wherein the pawl member of the ratchet mechanism is pivoted to engage the ratchet teeth of the socket connector by rotation of the rotation wheel of the control member, so that the ratchet screwdriver is operated easily and conveniently, thereby facilitating a user operating the ratchet screwdriver to drive a workpiece.

A further objective of the present invention is to provide a ratchet screwdriver, wherein the pawl member of the ratchet mechanism is engaged with the ratchet teeth of the socket connector rigidly and exactly, so that the ratchet screwdriver is operated exactly without deviation, thereby facilitating the user operating the ratchet screwdriver.

In accordance with the present invention, there is provided a ratchet screwdriver, comprising a main rod, a driven shaft, a ratchet mechanism, a socket connector, and a control member, wherein:

the main rod has a first end having a central portion formed with a shaft hole and a peripheral wall formed with a pivot slot communicating with the shaft hole and a guide slot communicating with the shaft hole;

the driven shaft is rotatably mounted in the shaft hole of the main rod and has a first end formed with a receiving hole communicating with the pivot slot of the main rod and a second end formed with a receiving bore communicating with the guide slot of the main rod;

the ratchet mechanism is mounted on the main rod and includes a pawl member pivotally mounted in the pivot slot of the main rod and having a first side formed with a first toothed face and a second toothed face and a second side formed with an urging face, a positioning stub mounted in the receiving hole of the driven shaft and having a first end urged on the urging face of the pawl member, and a compression spring urged between a second end of the positioning stub and the driven shaft;

the socket connector is mounted on the main rod and has an end having an inner wall formed with a plurality of ratchet teeth meshing with either one of the first toothed face and the second toothed face of the pawl member; and the control member is mounted on the main rod and includes a rotation wheel rotatably mounted on the main rod, a mounting barrel mounted in the receiving bore of the driven shaft for rotating the driven shaft, a limit rod having a first end mounted in the mounting barrel and a second end fixed on the rotation wheel to rotate therewith, and a compression spring urged between the mounting barrel and the first end of the limit rod.

Further benefits and advantages of the present invention will become apparent after a careful reading of the detailed description with appropriate reference to the accompanying drawings.

DETAILED DESCRIPTION OF THE INVENTION

Figure 1:
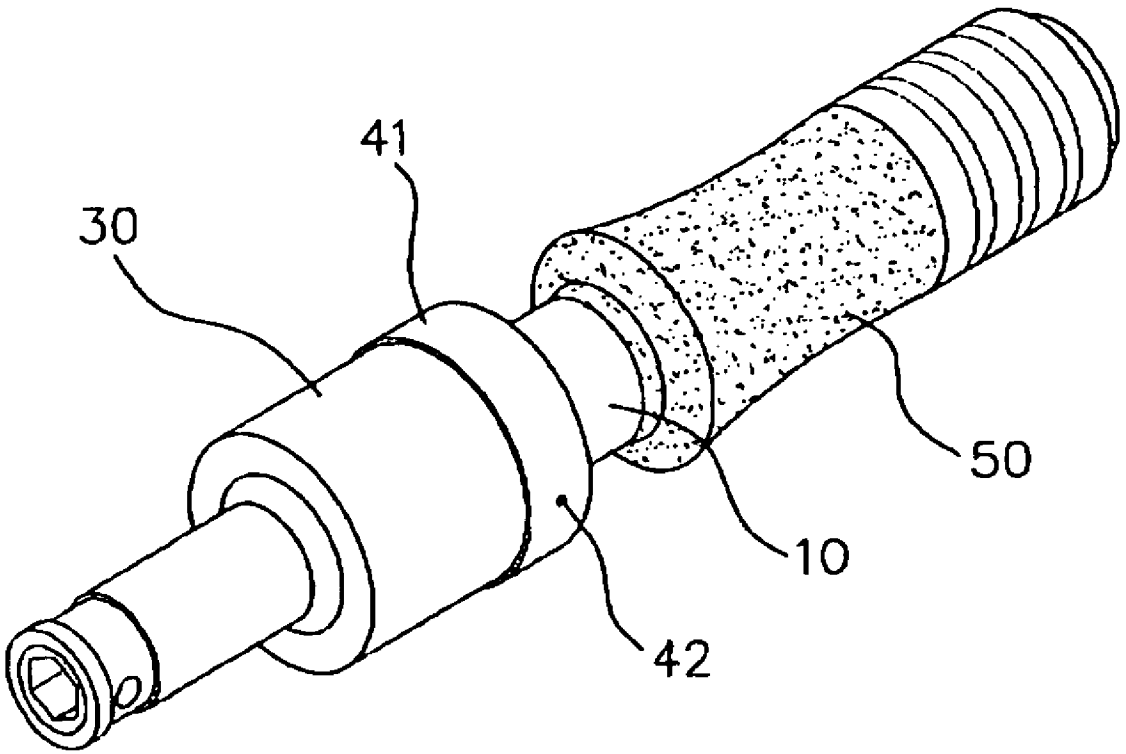
FIG. 1 is a perspective view of a ratchet screwdriver in accordance with the preferred embodiment of the present invention.
Figure 2:
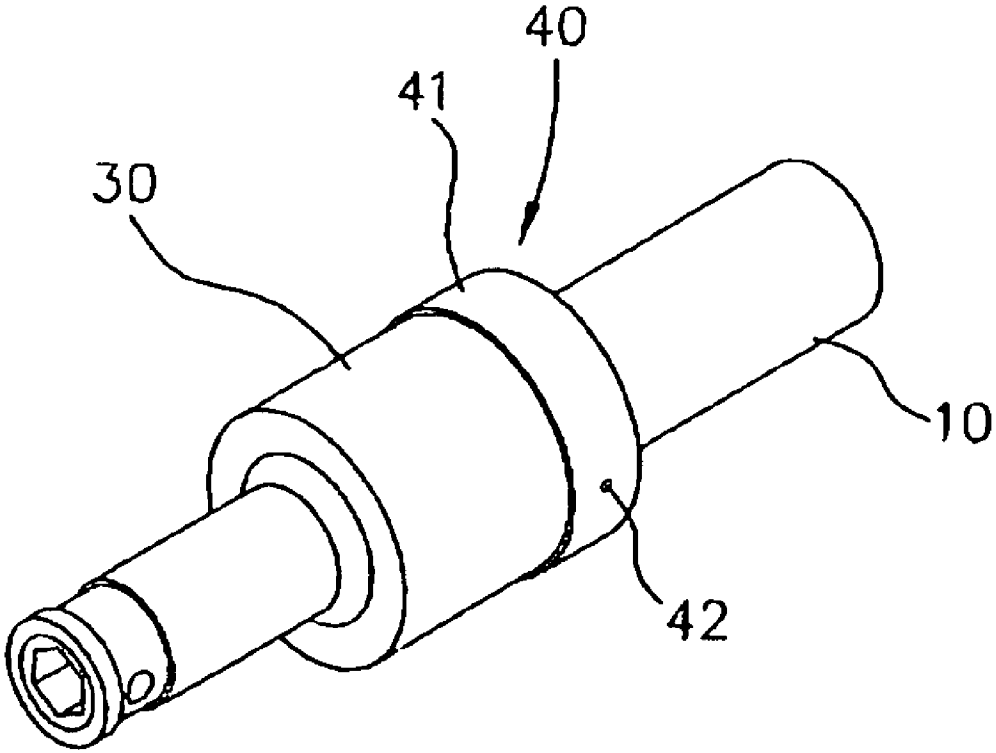
FIG. 2 is a partially perspective view of the ratchet screwdriver as shown in FIG. 1.
Figure 3:
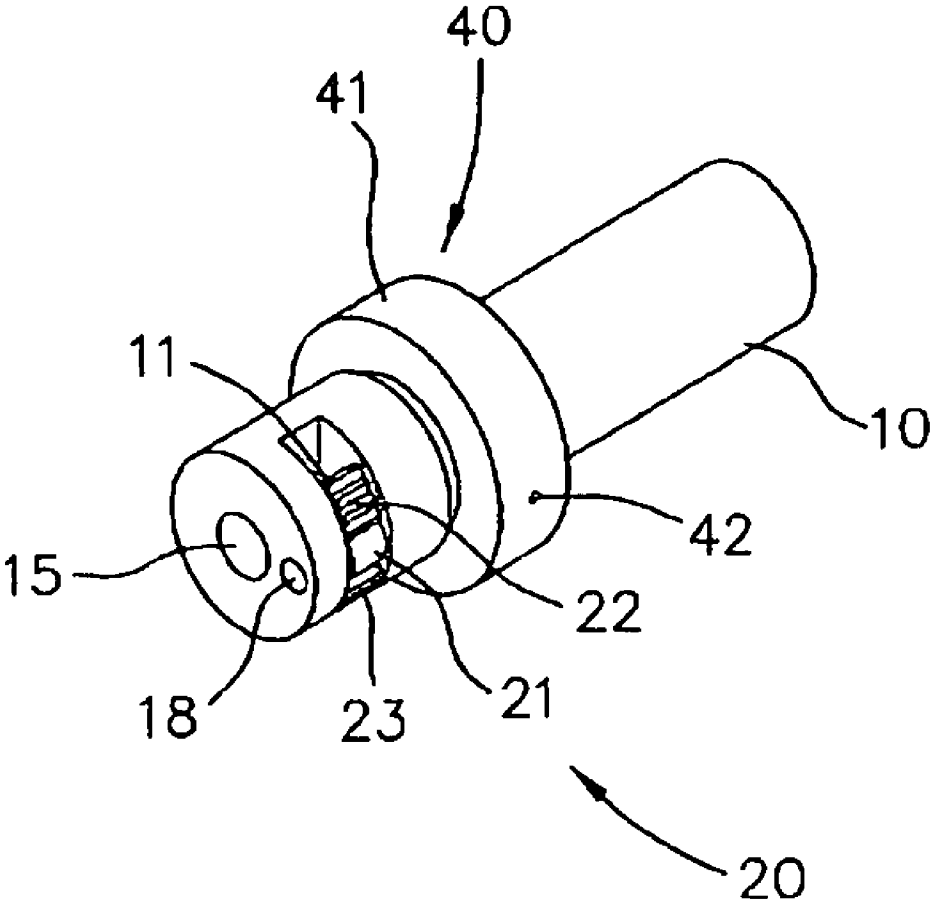
FIG. 3 is a partially perspective view of the ratchet screwdriver as shown in FIG. 1.
Figure 4:
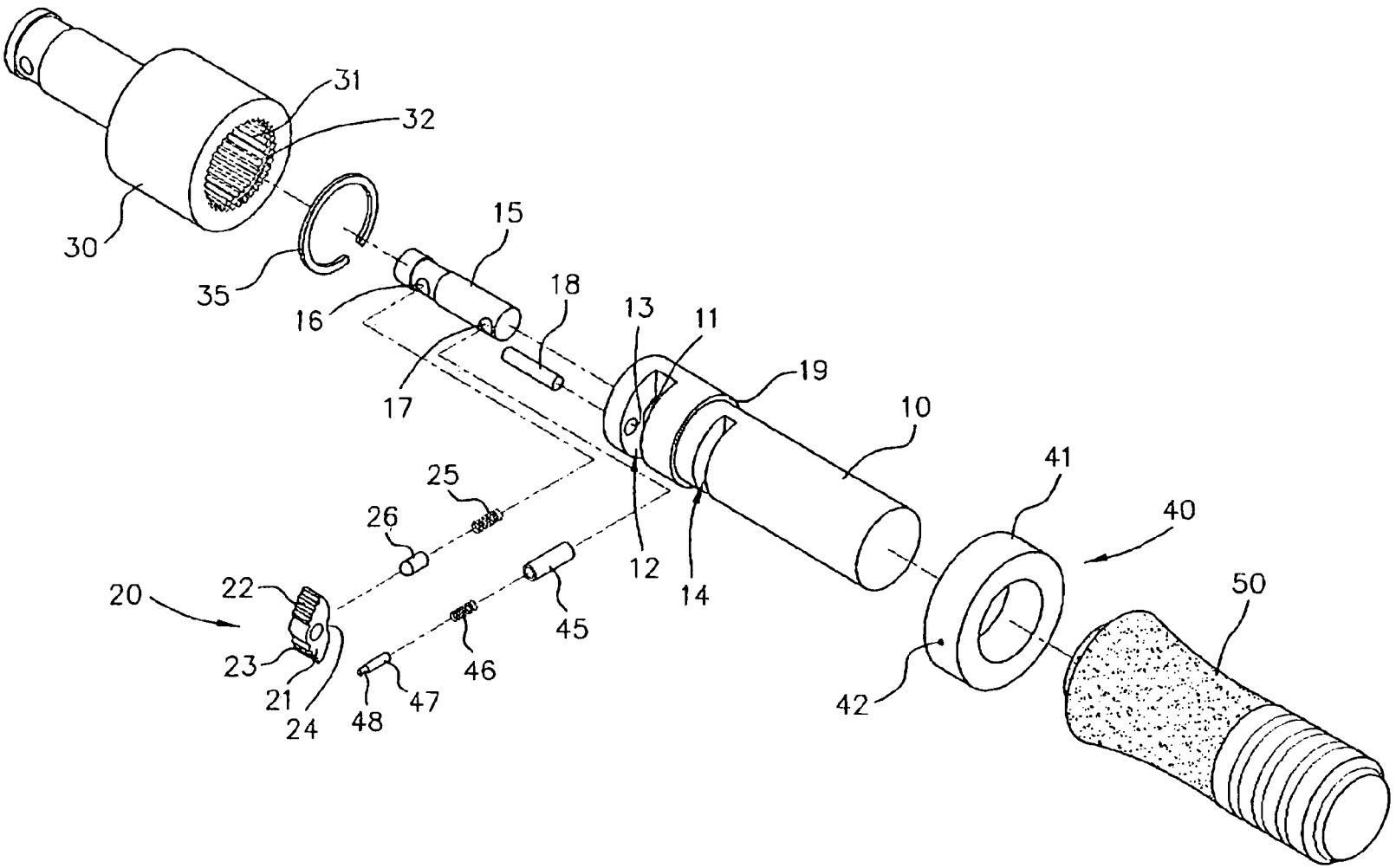
FIG. 4 is an exploded perspective view of the ratchet screwdriver as shown in FIG. 1.
Figure 5:
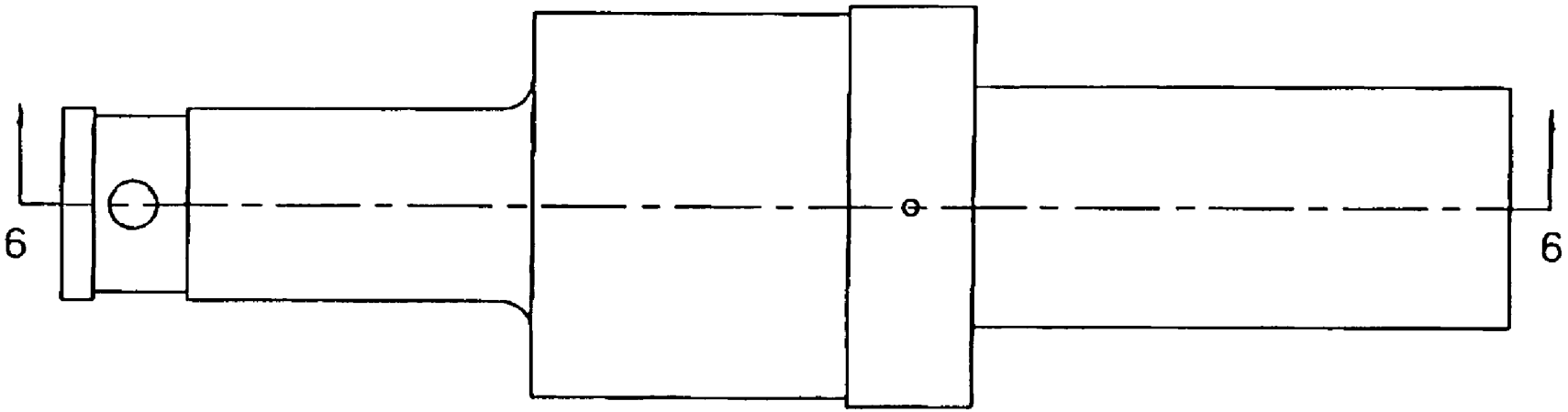
FIG. 5 is a plan view of the ratchet screwdriver as shown in FIG. 2.
Figure 6:
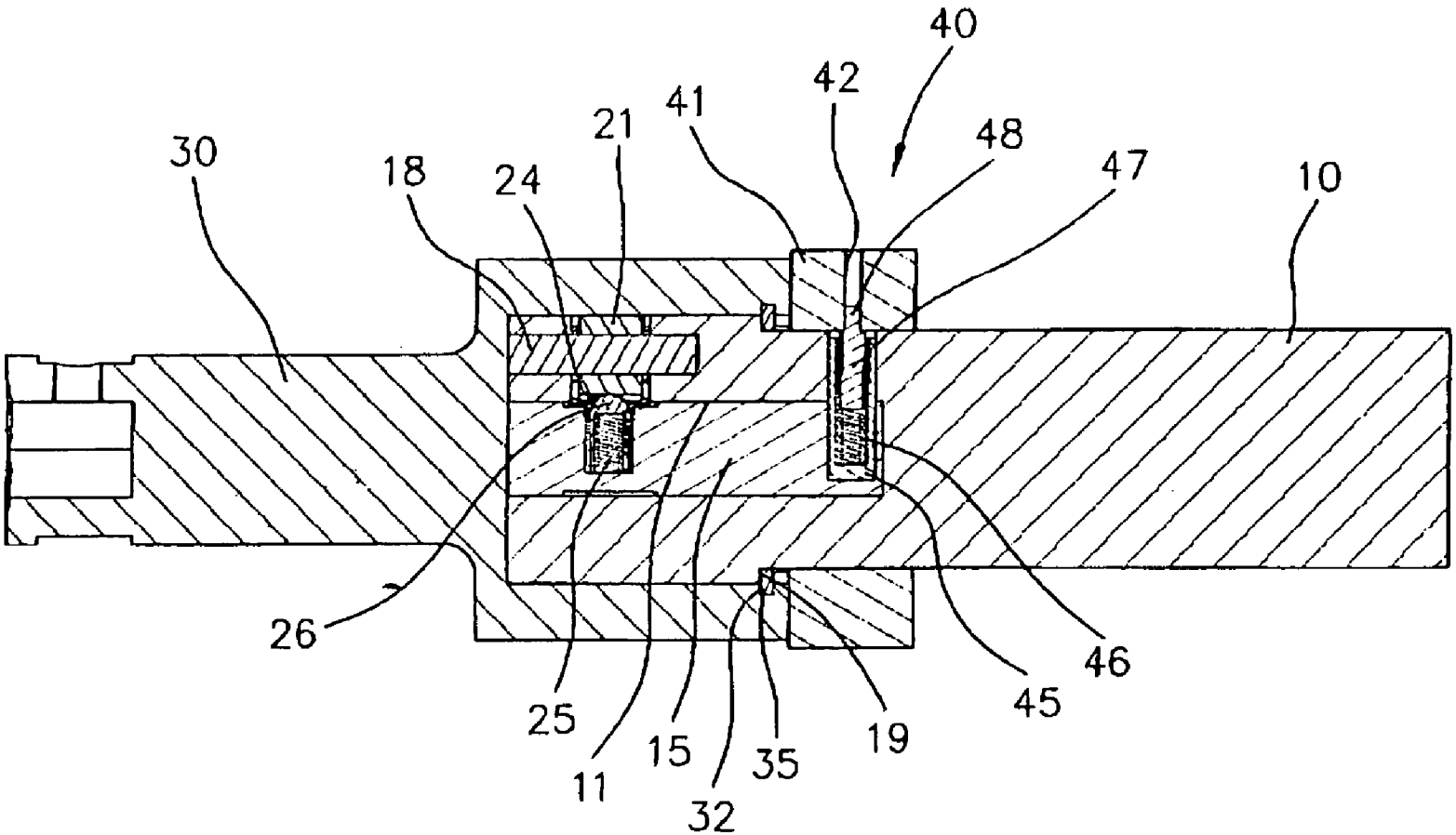
FIG. 6 is a plan cross-sectional view of the ratchet screwdriver taken along line 6—6 as shown in FIG. 5.
Figure 7:
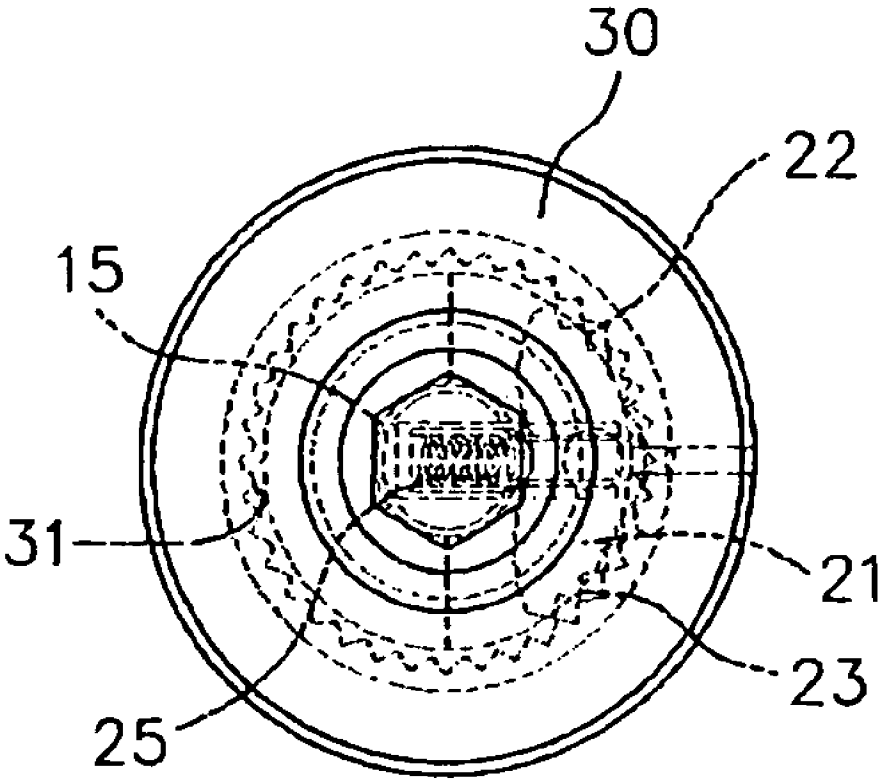
FIG. 7 is a plan cross-sectional view of the ratchet screwdriver as shown in FIG. 5.

Referring to the drawings and initially to FIGS. 1–9, a ratchet screwdriver in accordance with the preferred embodiment of the present invention comprises a main rod 10, a driven shaft 15, a ratchet mechanism 20, a socket connector 30, a control member 40, and a handle 50.

The main rod 10 has a first end having a central portion formed with a shaft hole 11 and a peripheral wall formed with a semi-circular pivot slot 12 communicating with the shaft hole 11 and a semi-circular guide slot 14 communicating with the shaft hole 11. The main rod 10 has an end face formed with a mounting hole 13 extended through the pivot slot 12. The main rod 10 has a periphery formed with an annular retaining shoulder 19 located between the pivot slot 12 and the guide slot 14.

The driven shaft 15 is rotatably mounted in the shaft hole 11 of the main rod 10 and has a first end formed with a receiving hole 16 communicating with the pivot slot 12 of the main rod 10 and a second end formed with a receiving bore 17 communicating with the guide slot 14 of the main rod 10.

Figure 9:
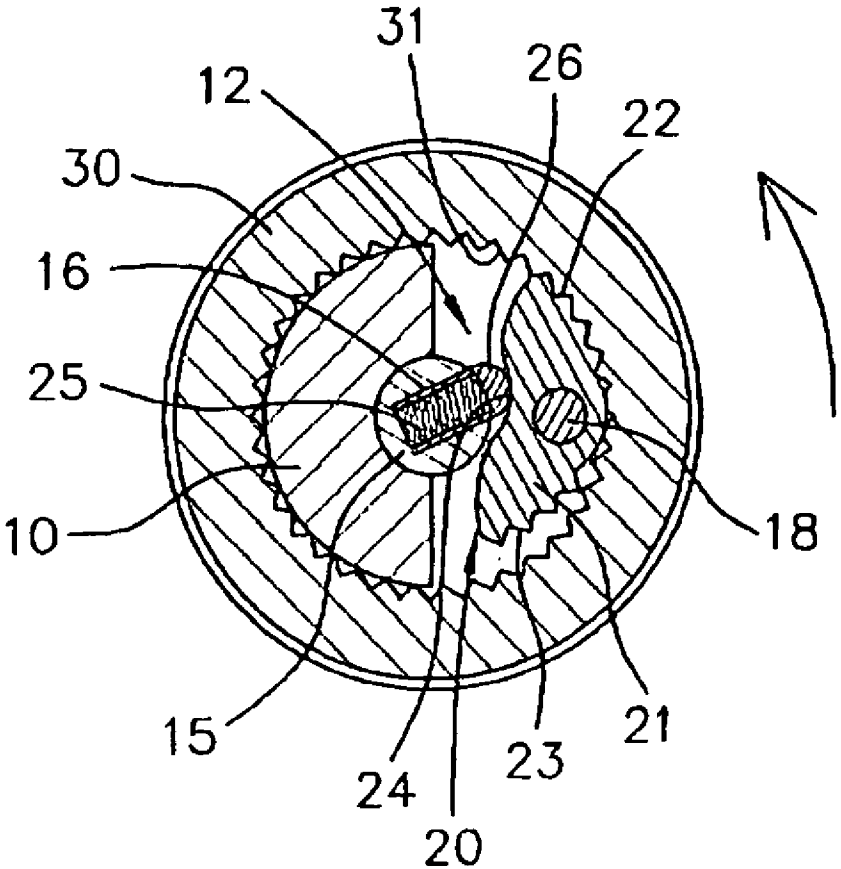
FIG. 9 is a plan cross-sectional operational view of the ratchet screwdriver as shown in FIG. 3.

The ratchet mechanism 20 is mounted on the main rod 10 and includes a pawl member 21 pivotally mounted in the pivot slot 12 of the main rod 10 and having a first side formed with a first toothed face 22 and a second toothed face 23 and a second side formed with an arcuate concave urging face 24, a positioning stub 26 mounted in the receiving hole 16 of the driven shaft 15 and having a first end urged on the urging face 24 of the pawl member 21, and a compression spring 25 urged between a second end of the positioning stub 26 and the driven shaft 15. Each of the first toothed face 22 and the second toothed face 23 of the pawl member 21 protrudes outward from the pivot slot 12 of the main rod 10. A pivot shaft 18 is mounted in the mounting hole 13 of the main rod 10, and the pawl member 21 is pivotally mounted on the pivot shaft 18. As shown in FIG. 9, the second end of the positioning stub 26 has a hollow inside for receiving the compression spring 25.

The socket connector 30 is mounted on the main rod 10 for mounting a driver head (not shown) and has an end having an inner wall formed with a plurality of ratchet teeth 31 meshing with either one of the first toothed face 22 and the second toothed face 23 of the pawl member 21. The inner wall of the socket connector 30 is formed with an annular snap groove 32. A C-shaped snap ring 35 is mounted in the snap groove 32 of the socket connector 30 and rested on the retaining shoulder 19 of the main rod 10 to retain the socket connector 30 on the main rod 10.

The control member 40 is mounted on the main rod 10 and includes a rotation wheel 41 rotatably mounted on the main rod 10, a cup-shaped mounting barrel 45 mounted in the receiving bore 17 of the driven shaft 15 for rotating the driven shaft 15, a limit rod 47 having a first end mounted in the mounting barrel 45 and a second end fixed on the rotation wheel 41 to rotate therewith, and a compression spring 46 urged between the mounting barrel 45 and the first end of the limit rod 47. The mounting barrel 45 has a first end mounted in the receiving bore 17 of the driven shaft 15 and a second end rested on an inner wall of the rotation wheel 41. The rotation wheel 41 has a periphery formed with a fixing hole 42 aligning with the guide slot 14 of the main rod 10, and the second end of the limit rod 47 is formed with a protruding insertion stub 48 inserted into the fixing hole 42 of the rotation wheel 41.

The handle 50 is mounted on a second end of the main rod 10 and is spaced from the rotation wheel 41 of the control member 40.

Figure 8:
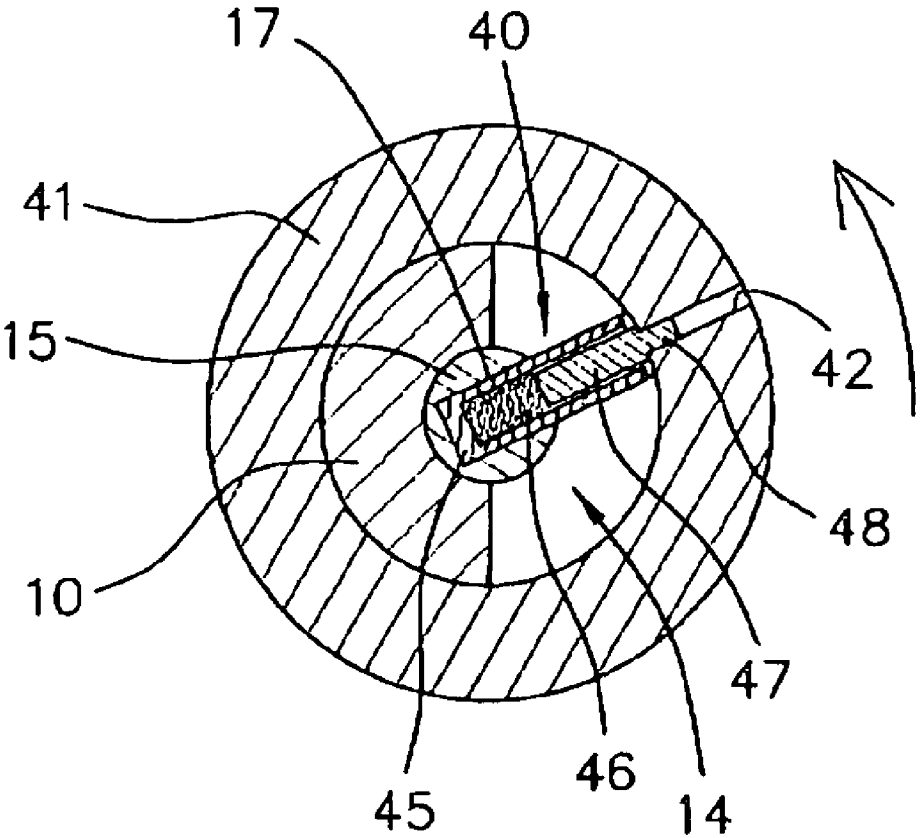
FIG. 8 is a plan cross-sectional operational view of the ratchet screwdriver as shown in FIG. 3.

In operation, referring to FIGS. 8–11 with reference to FIGS. 1–7, when the rotation wheel 41 is rotated on the main rod 10 counterclockwise as shown in FIG. 8, the limit rod 47 is rotated by rotation of the rotation wheel 41 to rotate the mounting barrel 45 which rotates the driven shaft 15 which rotates the positioning stub 26 which is moved to press the urging face 24 of the pawl member 21 so as to pivot the pawl member 21 about the pivot shaft 18, so that the first toothed face 22 of the pawl member 21 is moved to mesh with the ratchet teeth 31 of the socket connector 30 as shown in FIG. 9. Thus, the socket connector 30 is secured on the main rod 10, so that the socket connector 30 is driven by rotation of the main rod 10 to rotate in one direction only.

Figure 10:
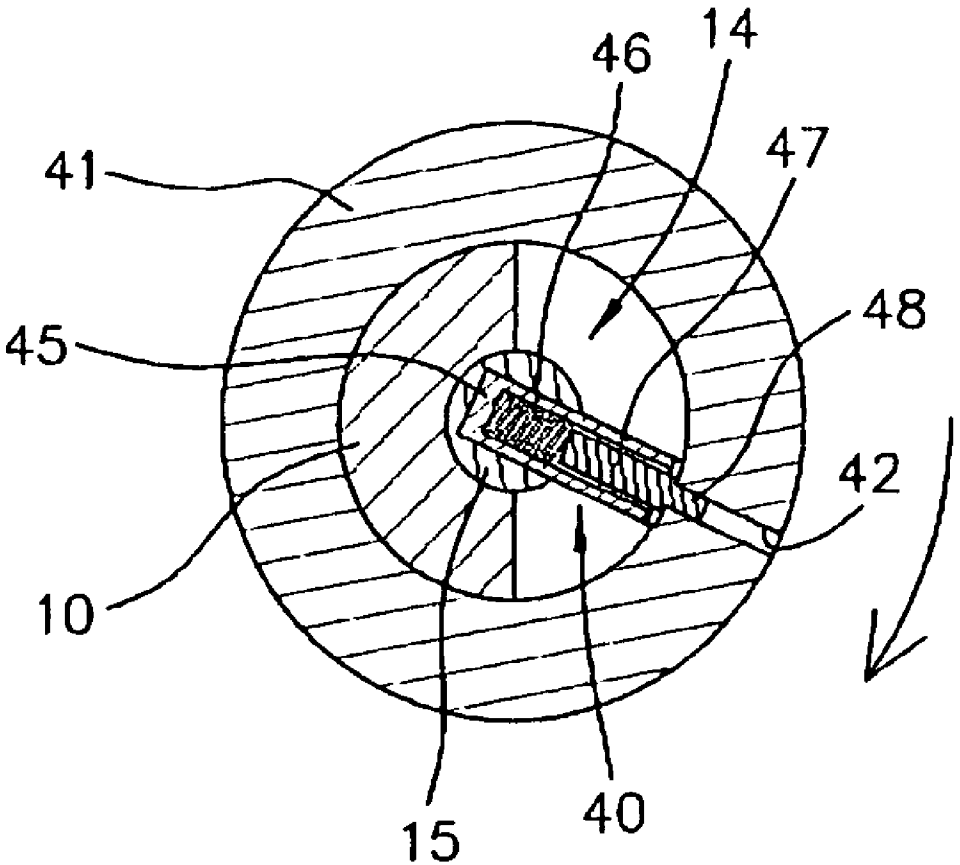
FIG. 10 is a plan cross-sectional operational view of the ratchet screwdriver as shown in FIG. 3.
Figure 11:
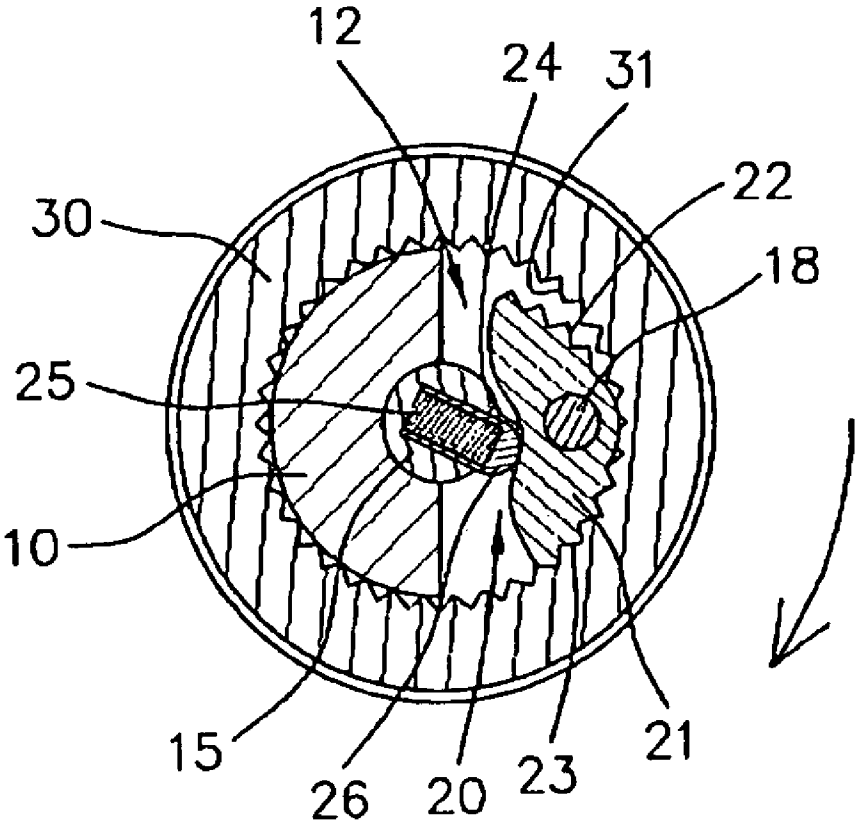
FIG. 11 is a plan cross-sectional operational view of the ratchet screwdriver as shown in FIG. 3.

Alternatively, when the rotation wheel 41 is rotated on the main rod 10 clockwise as shown in FIG. 10, the limit rod 47 is rotated by rotation of the rotation wheel 41 to rotate the mounting barrel 45 which rotates the driven shaft 15 which rotates the positioning stub 26 which is moved to press the urging face 24 of the pawl member 21 so as to pivot the pawl member 21 about the pivot shaft 18, so that the second toothed face 23 of the pawl member 21 is moved to mesh with the ratchet teeth 31 of the socket connector 30 as shown in FIG. 11. Thus, the socket connector 30 is secured on the main rod 10, so that the socket connector 30 is driven by rotation of the main rod 10 to rotate in the other direction only.

Accordingly, the ratchet mechanism 20 is directly actuated by the control member 40 to engage the socket connector 30, so that the ratchet screwdriver is operated actually and exactly. In addition, the pawl member 21 of the ratchet mechanism 20 is pivoted to engage the ratchet teeth 31 of the socket connector 30 by rotation of the rotation wheel 41 of the control member 40, so that the ratchet screwdriver is operated easily and conveniently, thereby facilitating a user operating the ratchet screwdriver to drive a workpiece. Further, the pawl member 21 of the ratchet mechanism 20 is engaged with the ratchet teeth 31 of the socket connector 30 rigidly and exactly, so that the ratchet screwdriver is operated exactly without deviation, thereby facilitating the user operating the ratchet screwdriver.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet screwdriver, comprising a main rod, a driven shaft, a ratchet mechanism, a socket connector, and a control member, wherein:

the main rod has a first end having a central portion formed with a shaft hole and a peripheral wall formed with a pivot slot communicating with the shaft hole and a guide slot communicating with the shaft hole;

the driven shaft is rotatably mounted in the shaft hole of the main rod and has a first end formed with a receiving hole communicating with the pivot slot of the main rod and a second end formed with a receiving bore communicating with the guide slot of the main rod;

the ratchet mechanism is mounted on the main rod and includes a pawl member pivotally mounted in the pivot slot of the main rod and having a first side formed with a first toothed face and a second toothed face and a second side formed with an urging face, a positioning stub mounted in the receiving hole of the driven shaft and having a first end urged on the urging face of the pawl member, and a compression spring urged between a second end of the positioning stub and the driven shaft;

the socket connector is mounted on the main rod and has an end having an inner wall formed with a plurality of ratchet teeth meshing with either one of the first toothed face and the second toothed face of the pawl member; and the control member is mounted on the main rod and includes a rotation wheel rotatably mounted on the main rod, a mounting barrel mounted in the receiving bore of the driven shaft for rotating the driven shaft, a limit rod having a first end mounted in the mounting barrel and a second end fixed on the rotation wheel to rotate therewith, and a compression spring urged between the mounting barrel and the first end of the limit rod.

2. The ratchet screwdriver in accordance with claim 1, wherein the pivot slot of the main rod is substantially semi-circular.

3. The ratchet screwdriver in accordance with claim 1, wherein the guide slot of the main rod is substantially semi-circular.

4. The ratchet screwdriver in accordance with claim 1, wherein the urging face of the pawl member has a substantially arcuate concave shape.

5. The ratchet screwdriver in accordance with claim 1, wherein the mounting barrel is substantially cup-shaped.

6. The ratchet screwdriver in accordance with claim 1, wherein the main rod has an end face formed with a mounting hole extended through the pivot slot, a pivot shaft is mounted in the mounting hole of the main rod, and the pawl member is pivotally mounted on the pivot shaft.

7. The ratchet screwdriver in accordance with claim 1, wherein the main rod has a periphery formed with an annular retaining shoulder located between the pivot slot and the guide slot, the inner wall of the socket connector is formed with an annular snap groove, and a C-shaped snap ring is mounted in the snap groove of the socket connector and rested on the retaining shoulder of the main rod to retain the socket connector on the main rod.

8. The ratchet screwdriver in accordance with claim 1, wherein each of the first toothed face and the second toothed face of the pawl member protrudes outward from the pivot slot of the main rod.

9. The ratchet screwdriver in accordance with claim 1, wherein the second end of the positioning stub has a hollow inside for receiving the compression spring.

10. The ratchet screwdriver in accordance with claim 1, wherein the mounting barrel has a first end mounted in the receiving bore of the driven shaft and a second end rested on an inner wall of the rotation wheel.

11. The ratchet screwdriver in accordance with claim 1, wherein the rotation wheel has a periphery formed with a fixing hole aligning with the guide slot of the main rod, and the second end of the limit rod is formed with a protruding insertion stub inserted into the fixing hole of the rotation wheel.

12. The ratchet screwdriver in accordance with claim 1, further comprising a handle mounted on a second end of the main rod and is spaced from the rotation wheel of the control member.

* * * * *